US005426342A

United States Patent [19]

Nakamura et al.

[11] Patent Number: 5,426,342

[45] Date of Patent: Jun. 20, 1995

[54] FLUORESCENT DISPLAY DEVICE AND METHOD FOR MANUFACTURING SAME

[75] Inventors: Yuzo Nakamura, Kyoto; Hiroaki Kawasaki; Tadashi Mizohata, both of Mobara, all of Japan

[73] Assignee: Futaba Denshi Kogyo K.K., Mobara, Japan

[21] Appl. No.: 913,346

[22] Filed: Jul. 15, 1992

[30] Foreign Application Priority Data

Jul. 15, 1991 [JP] Japan ..... 3-201401

[51] Int. Cl.[6] ..... H01J 1/62

[52] U.S. Cl. ..... 313/496; 156/239

[58] Field of Search ..... 313/495, 496, 497; 445/24; 156/239, 230, 240

[56] References Cited

U.S. PATENT DOCUMENTS 4,841,194 6/1989 Kishino et al. ..... 313/496

4,899,081 2/1990 Kishino et al. ..... 313/496

*Primary Examiner*—Tommy Chin

*Assistant Examiner*—Kara A. Farnandez

*Attorney, Agent, or Firm*—Oblon, Spivak, McClelland, Maier & Neustadt

[57] ABSTRACT

A fluorescent display device capable of controlling impinge of electrons emitted from cathodes on phosphor layers and accomplishing satisfactory luminous display while preventing leakage luminance, the fluorescent display device is so constructed that a display section and a control electrode are arranged on substantially the same plane and the control electrode is provided with a plurality of apertures and arranged on the phosphor layer through an insulating layer of substantially the same pattern. Also, a method for manufacturing a fluorescent display device is disclosed which is capable of decreasing a manufacturing cost and improving productive efficiency while providing a fluorescent display device exhibiting such an advantage as described above. The fluorescent display device is manufactured by superposing a transfer material on a fluorescent substrate structure to transfer the former onto the latter, releasing a base film from the transfer material transferred onto the fluorescent substrate structure, and calcining the fluorescent substrate structure.

10 Claims, 5 Drawing Sheets

FLUORESCENT DISPLAY DEVICE AND METHOD FOR MANUFACTURING SAME

BACKGROUND OF THE INVENTION

This invention relates to a fluorescent display device having grid electrodes or control electrodes arranged on substantially the same plane as a display section and a method for manufacturing the same, and more particularly to a fluorescent display device including control electrodes of which electric field control is facilitated and a method for manufacturing the fluorescent display device at a low manufacturing cost and with high productive efficiency.

In general, a fluorescent display device, as shown in FIG. 8, includes a fluorescent substrate structure 19 comprising a substrate 8 made of an insulating and heat-resistant material such as a glass plate or the like and a display section 10 arranged on the substrate 8, a light-permeable front cover 13 made of a glass plate or the like and arranged opposite to the fluorescent substrate structure 19, and side plates 14 forming a side portion of the display device, which are hermetically assembled together through a sealing material such as low-melting frit glass or the like to from a vacuum casing 15. The display section 10 includes anodes 7 and phosphor layers 6 deposited thereon and is arranged in the vacuum casing 15 together with cathodes 11 for emitting electrons and grid electrodes 12 formed with apertures in a mesh-like manner. The vacuum casing 15 is also provided therein with wirings 17 in a manner to be arranged below insulating films 18 and electrically connected to the display section 10. To the wirings 17 are connected lead wires 16 which are outward led out through the vacuum casing 15. In the fluorescent display device thus constructed, the grid or control electrodes 12 and anodes 7 function to select and control electrons emitted from the cathodes 11 so as to impinge them on the phosphor layers 6, resulting in desired luminous display being carried out.

As will be noted from the above, in the conventional fluorescent display device, the grid electrodes 12 are arranged above the phosphor layers 6 in a manner to be spaced therefrom, therefore, it is very hard to keep a distance between each of the grid electrodes 12 and each of the phosphors 6 constant, resulting in non-uniformity in luminance.

In manufacturing of the fluorescent display device, the grid electrodes 12 are made by subjecting metal sheets of stainless steel or the like to etching at least one by one at each time. Also, each of the grid electrodes 12 is required to be formed into a configuration which permits them to be arranged between the cathode 11 and the anode 7. Further, formation of the grid electrode 12 into a large size causes it to be deflected at a central portion thereof due to its weight, so that it is hard to keep a gap between the phosphor layer 6 and the anode 7 constant. Thus, the conventional method leads to deterioration of productivity and an increase in manufacturing cost.

SUMMARY OF THE INVENTION

The present invention has been made in view of the foregoing disadvantage of the prior art.

Accordingly, it is an object of the present invention to provide a fluorescent display device which is capable of exhibiting a satisfactory luminous display.

It is another object of the present invention to provide a fluorescent display device which is capable of preventing non-uniformity in luminous display.

It is a further object of the present invention to provide a fluorescent display device which is capable of effectively preventing leakage luminance.

It is still another object of the present invention to provide a method for manufacturing a fluorescent display device which is capable of providing a fluorescent display device exhibiting a luminous display free of leakage luminance and non-uniformity at a low cost and with high productive efficiency.

In accordance with one aspect of the present invention, a fluorescent display device is provided. The fluorescent display device comprises a hermetic envelope of a flat box-like shape including a substrate, a front cover arranged opposite to the substrate and side plates arranged between the substrate and the front cover; display sections arranged on the substrate and each including phosphor-deposited anodes; grids arranged in the envelope so as to be spaced from the display sections; and cathodes arranged in the envelope so as to be spaced from the grids. The grids or grid or control electrodes each are formed with a plurality of apertures and arranged on at least a surface of the display section through an insulating layer.

In a preferred embodiment of the present invention, the grids each are arranged on a surface of a phosphor layer of the display section and therearound.

In accordance with another aspect of the present invention, a method for manufacturing a fluorescent display device is provided. The method comprises the step of superposing a transfer material on a fluorescent substrate structure to transfer the transfer material onto the fluorescent substrate structure, wherein the transfer material includes a base film, a grid electrode layer formed with a plurality of apertures and formed on the base film, an insulating layer formed with a plurality of apertures and arranged on the grid electrode layer so as to cover it, and an adhesive layer arranged on the insulating layer so as to cover at least the insulating layer, and the fluorescent substrate structure includes a substrate, and an anode and a phosphor layer laminated on the substrate in order. The method further comprises the steps of releasing the base film from the transfer material transferred onto the fluorescent substrate structure and calcining the fluorescent substrate structure.

BRIEF DESCRIPTION OF THE DRAWINGS

These and other objects and many of the attendant advantages of the present invention will be readily appreciated as the same becomes better understood by reference to the following detailed description when considered in connection with the accompanying drawings; wherein:

FIG. 1(*b*) is a longitudinal sectional view of the fluorescent display device shown in FIG. 1(*a*);

DETAILED DESCRIPTION OF THE PREFERRED EMBODIMENTS

Now, the present invention will be described hereinafter with reference to FIGS. 1 to 7.

Figure 1A:
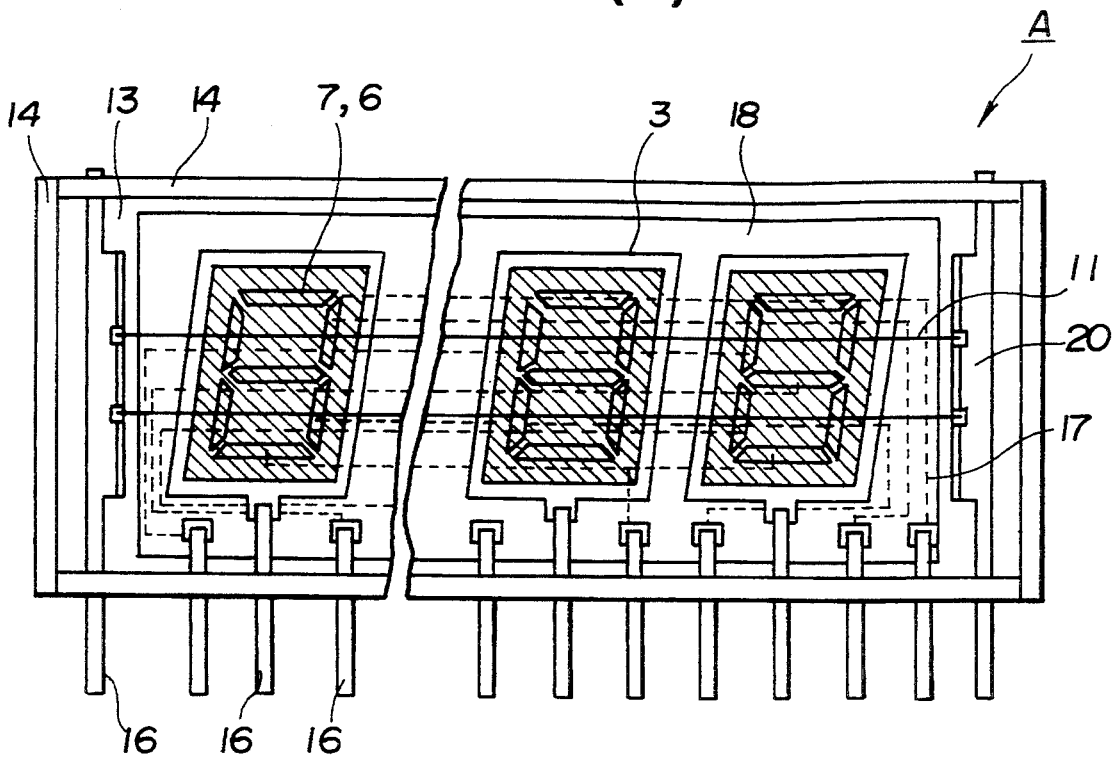
FIG. 1(*a*) is a plan view showing an embodiment of a fluorescent display device according to the present invention.
Figure 1B:
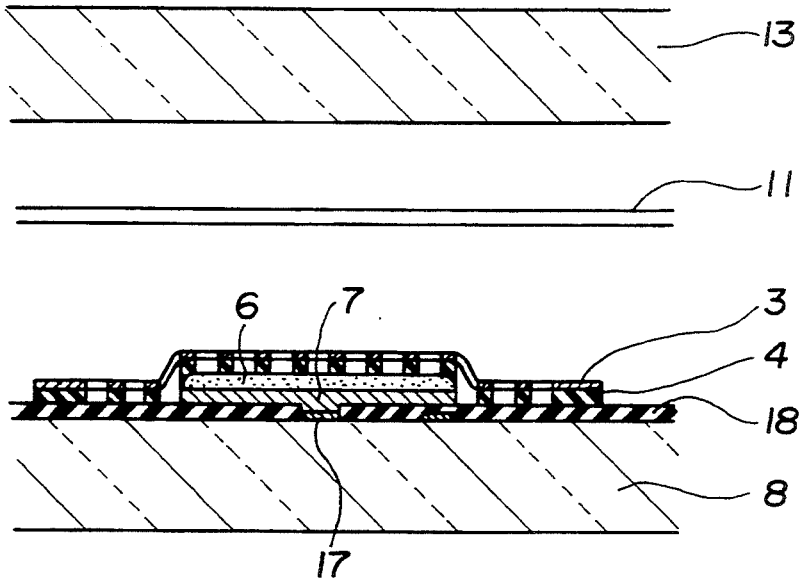

FIGS. 1(*a*) and 1(*b*) show an embodiment of a fluorescent display device according to the present invention. A fluorescent display device of the illustrated embodiment which is generally designated at reference character A includes a substrate 8 made of an insulating material such as a glass plate or the like, a front cover 13 made of a light-permeable material such as a glass plate and arranged opposite to the substrate 8, and side plates 14, which are joined together by means of a sealing material such as low-melting frit glass or the like to form a hermetic or air-tight envelope.

On an upper surface of the substrate 8 are formed an insulating layer 18 and conductors 17 such as wiring conductors and the like by screen printing or the like, on which anodes 7 made of graphite or the like are then formed depending on a display pattern by screen printing or the like. Each of the anodes 7 has a phosphor layer 6 deposited thereon by screen printing or the like. The anodes 7 and phosphor layers 6 thus constructed cooperate with each other to constitute each of display sections, which display sections then cooperate with the substrate 8 to constitute a fluorescent substrate structure 19. Further, the fluorescent display device includes a grid electrode or a control electrode (also merely referred to as "grid" herein) 3 laminatedly arranged on the phosphor layers 6 of each display section and a portion of the insulating layer 18 around the phosphor layers through an insulating layer 4 by transfer. The insulating layer 4 and control electrode 3, as shown in FIG. 1(*a*), are arranged so as to extend over a plurality of the display sections and each are formed on at least a portion thereof positionally corresponding to each display section with a plurality of mesh-like or slit-like apertures.

Above the control electrodes are stretchedly arranged cathodes 11 through supports 20, which are adapted to emit electrons when the cathodes are heated due to feeding a current thereto. The fluorescent display device also includes lead wires 16 connected to the control electrodes 3, anodes 7 and cathodes 11 indirectly through the wiring conductors 17 or directly.

The grid or control electrodes 3, as described above, each are arranged so as to extend over a plurality of the display sections concerned with each other. The anodes 7 of the display sections corresponding to one control electrode are electrically commonly connected through the wiring conductors 17 to the anodes 7 of the the display sections corresponding to another control electrode 3.

Figure 2:
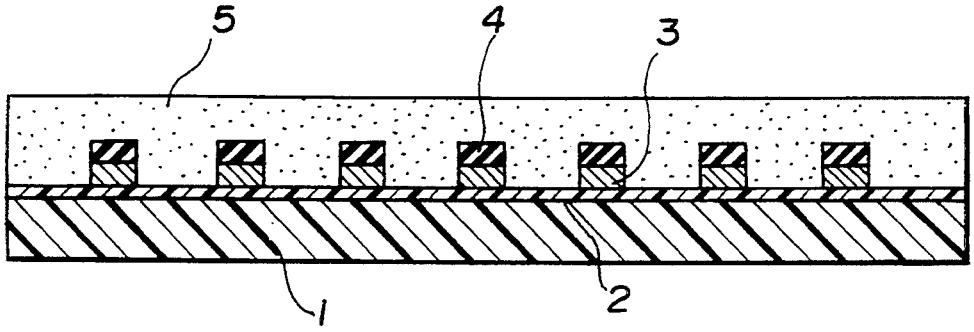
FIGS. 2 to 4 each are a sectional view showing an embodiment of a method for manufacturing a fluorescent display device according to the present invention.
Figure 5:
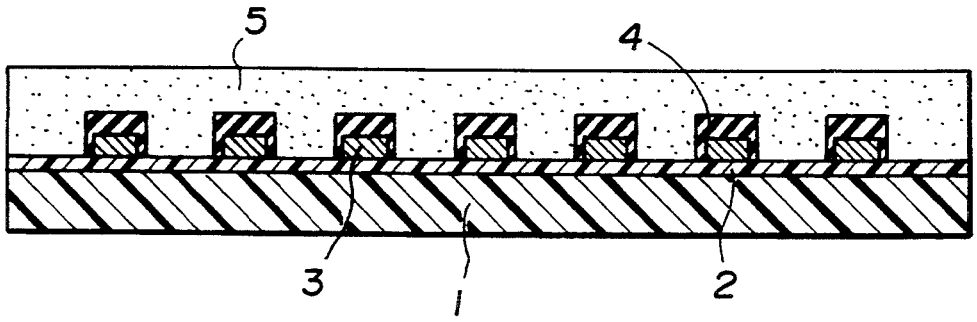
FIGS. 5 to 7 each are a sectional view showing another embodiment of a method for manufacturing a fluorescent display device according to the present invention.

A material used for the above-described transfer or a transfer material is so constructed that control electrode or grid electrode layers 3, insulating layers 4 and adhesive layers 5 are laminated on a base film 1 in turn as shown in FIGS. 2 and 5.

The base film 1 may be made of a material used as a base film for a conventional transfer material. Thus, a plastic film such as a polyester film, a polypropylene film, a polyethylene film, a polyimido film, a nylon film or a cellulose film; a composite film of such a plastic film and paper; waxed paper; or the like may be used for the base film. The base film 1 may be subject to a release treatment so that it may be readily released from the transfer material after transfer. For this purpose, the base film 1 may be provided thereon with a release layer 2 which is releasable with the base film 1. The release layer 2 may be made of a thermoplastic resin material such as volatile acrylic resin, natural rubber, synthetic resin or the like. The release layer 2 may be formed by any suitable techniques including (FIG. 3) printing (FIG. 2) such as gravure printing or screen printing, coating such as roll coating, or the like. Also, the base film 1 may be formed thereon with a wax layer so that release of the base film 1 may be further promoted.

On the base film 1 is formed the grid electrode layer 3 provided with a plurality of apertures 9 (FIG. 4), on which the insulating layer 4 formed with apertures 9 is then formed so as to cover the grid electrode layer 3. When a pattern of the apertures of the insulating layer 4 to be formed is the same as that of the grid electrode layer 3, deposition of the insulating layer 4 on the grid electrode layer 3 by conventional printing techniques would lead to slight misregistration between both. Such misregistration causes a surface of the grid electrode layer 3 to be exposed at the apertures 9 of the insulating layer 4, so that the grid electrode layer 3 is contacted with the phosphor layer 6 during transfer to lead to a failure in insulation therebetween, resulting in a failure in control of electrons.

For the grid electrode layer 3, a deposited metal film or metal foil made of aluminum, nickel, chromium or the like, may be used.

The insulating layer 4 may be formed by conventional printing techniques such as screen printing, gravure printing or the like and functions to prevent the anode 7 and phosphor layer 6 from being contacted with the grid electrode layer 3 after the transfer. Also, the insulating layer is securely fixed on the substrate 8 by subsequent calcination. The insulating layer 4 may be made of any combination of insulating organic materials such as $SiO_2$, $B_2O_3$, $Al_2O_3$, PbO, ZnO and the like.

The apertures 9 of each of the grid electrode layer 3 and insulating layer 4 may be formed into a mesh-like or slit-like shape.

The adhesive layer 5 is formed as an uppermost layer of the transfer material. The adhesive layer 5 may be made of a material having good volatility like the release layer 2 and satisfactory adhesion to the substrate 18. To this end, a heat-sensitive and pressure-sensitive material such as acrylic resin, polyamide resin or the like may be used for the adhesive layer 5. The adhesive layer may be formed by printing such as gravure printing or screen printing, coating such as roll coating, or the like.

Figure 3:
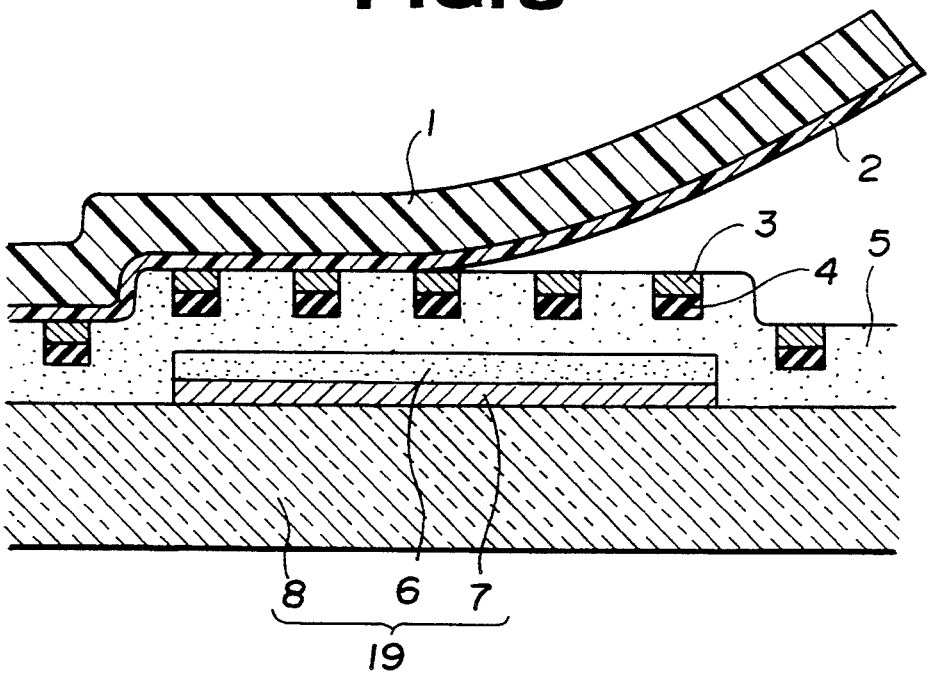
Figure 6:
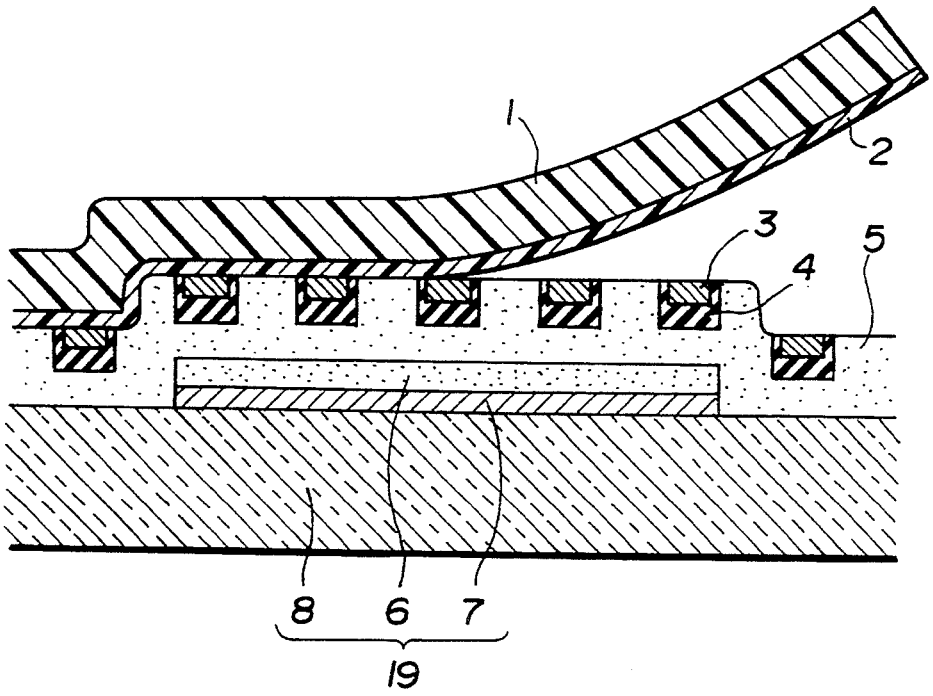

The transfer material thus constructed is pressed on a side of the adhesive layer 5 thereof against the substrate 8 on which the anode 7 and phosphor layer 6 are laminated in turn, and subject to transfer while being heated under pressure. The transfer may be suitably carried out under the conditions that a rubber surface temperature is set between 180° C. and 220° C. and a pressure is set within a range of from 50 kg to 150 kg (FIGS. 3 and 6).

Figure 4:
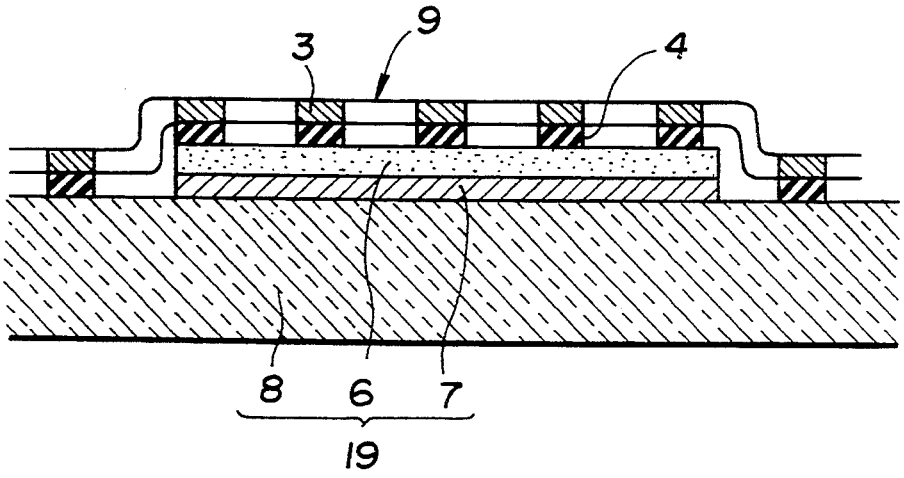
Figure 7:
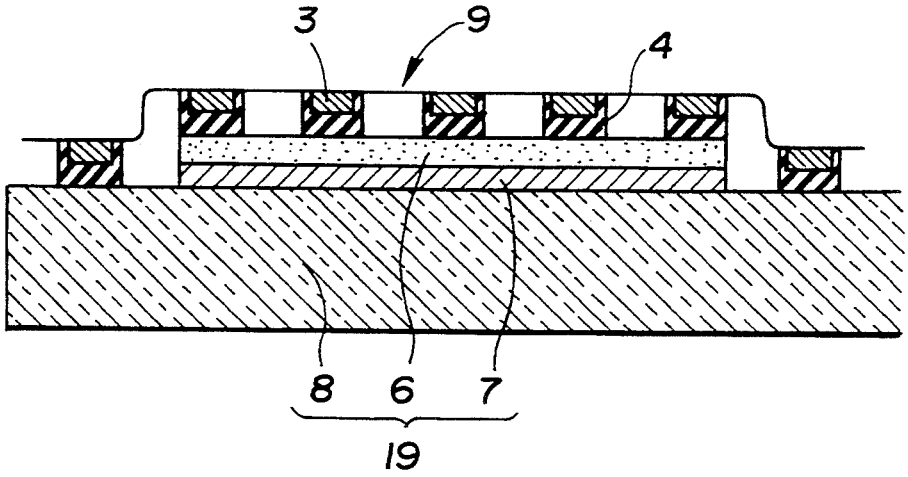
Figure 8:
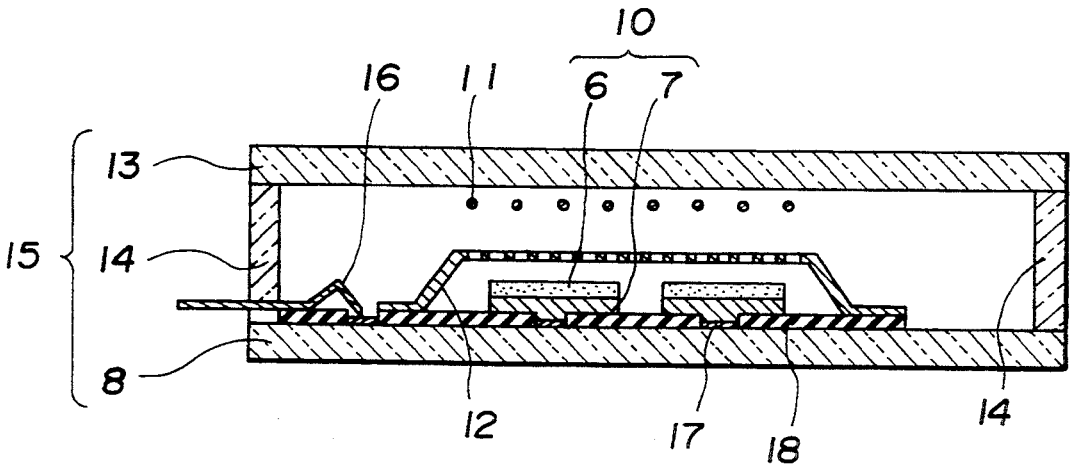
FIG. 8 PRIOR ART
FIG. 8 is a sectional view showing a conventional fluorescent display device.

Then, the base film 1 is released, followed by calcination to volatilize organic ingredients to finish the fluorescent display device. The calcination may be carried out at a temperature of 400° C. to 500° C. in an oxidizing atmosphere. The calcination permits the insulating layer to be densified due to a decrease in thickness thereof, so that it may be fixedly mounted on the substrate 8 having the anode 7 and phosphor layer 6 deposited thereon in turn, as shown in FIGS. 4 and 7.

In the present invention, the control electrodes each may be formed in such a manner that Al, Ag, Au or the like may be deposited directly on the display section through an insulating layer such as $SiO_2$ or the like using sputtering.

Formation of the control electrodes by transfer described above simplifies manufacturing of the fluorescent display device when the elements formed on the substrate such as the phosphor layer, anode conductors and the like as well are formed on the transfer film or base film.

Further, the fluorescent display device of the illustrated embodiment is of the type that a luminous display is observed through the front cover arranged opposite to the substrate. However, it is a matter of course that the present invention is conveniently applied to a fluorescent display device wherein a luminous display is observed through a substrate.

As can be seen from the foregoing, in the method of the illustrated embodiment, the transfer material which includes the base film, the grid electrode layer formed with a plurality of the apertures and deposited on the base film, the insulating layer formed with the apertures and deposited on the grid electrode layer so as to cover it, and the adhesive layer arranged so as to cover at least the insulating layer is transferred onto the fluorescent substrate structure wherein the anode and phosphor layer are laminatedly arranged on the substrate in turn, and then the base film is released to form the transfer material after calcination. Such construction of the illustrated embodiment permits the grid electrode layer to be readily formed in the form of a transferred layer on the fluorescent substrate structure. Also, arrangement of the insulating layer eliminates a necessity of forming the grid electrode layer into a configuration sufficient to keep it insulated from the phosphor layer. Thus, it will be noted that the method of the illustrated embodiment provides a satisfactory fluorescent display device while decreasing a manufacturing cost and improving productive efficiency.

Also, the fluorescent display device of the present invention is so constructed that the display section and control electrode are arranged on substantially the same plane and the control electrode is provided with a plurality of apertures and arranged on the phosphor layer through the insulating layer of substantially the same pattern. Such construction permits the control the electrode to be arranged on the phosphor layer as well as at a periphery thereof to control impinge of electrons emitted from the cathode on the phosphor layer. Also, it accomplishes satisfactory luminous display while preventing leakage luminance even when the display is carried out by dynamic driving of the control electrode and anode conductor. Further, it permits electrons emitted from the cathode to be sufficiently diffused to prevent non-uniformity in display even when a pattern of the display section is increased.

The present invention will be more readily understood with reference to the following example; however, the example is intended to illustrate the invention and is not to be construed to limit the scope of the invention.

EXAMPLE

The example was practiced in such a manner as shown in FIGS. 5 to 7. A base film 1 made of a film material of 25 μm in thickness selected from polypropylene and polyester was provided, on which a grid electrode layer 3 having a plurality of apertures 9 was arranged. Then, an insulating layer 4 mainly consisting of $SiO_2$ was deposited on the grid electrode layer 3 so as to cover it. Subsequently, a transfer material on which an adhesive layer 5 of 2 μm in thickness was deposited so as to cover at least the insulating layer 4 was laminatedly transferred onto a fluorescent substrate structure 19 wherein an anode 7 and a phosphor 6 are laminated on a glass substrate 8 in turn and the base film 1 was released, followed by calcination of the glass substrate 8 at 500° C. This resulted in a fluorescent display device free of misregistration between the grid electrode layer 3 and the insulating layer 4, as well as at a decreased manufacturing cost and with improved productive efficiency.

While a preferred embodiment of the invention has been described with a certain degree of particularity with reference to the drawings, obvious modifications and variations are possible in light of the above teachings. It is therefore to be understood that within the scope of the appended claims, the invention may be practiced otherwise than as specifically described.

What is claimed is:

1. A method for manufacturing a fluorescent display device comprising the steps of:

superposing a transfer material on a fluorescent substrate structure to transfer said transfer material onto said fluorescent substrate structure;

said transfer material including a base film, a grid electrode layer formed with a plurality of apertures and formed on said base film, an insulating layer formed with a plurality of apertures and arranged on said grid electrode layer so as to cover it, and an adhesive layer arranged on said insulating layer so as to cover at least said insulating layer;

said fluorescent substrate structure including a substrate, and an anode and a phosphor layer laminated on said substrate in order;

releasing said base film from said transfer material transferred onto said fluorescent substrate structure; and calcining said fluorescent substrate structure.

2. A method for manufacturing a fluorescent display device comprising the steps of:

forming a fluorescent substrate structure comprising the sub-steps of:

disposing an anode on a substrate;

disposing a phosphor layer on the anode;

forming a transfer layer separate from the fluorescent substrate structure comprising the sub-steps of:

disposing a release layer on a base film;

disposing a control electrode on the release layer;

disposing an insulating layer on the control electrode;

disposing an adhesive layer on the insulating layer;

forming said fluorescent display device comprising the sub-steps of:

press-contacting the transfer layer onto the fluorescent substrate structure with the adhesive layer in contact with the fluorescent substrate structure;

releasing the base film and release layer from the transfer layer and leaving the phosphor layer, control electrode and adhesive layer on the fluorescent substrate structure; and wherein the anode and control electrode selectively attract electrically charged particles to impinge on the phosphor layer, causing the phosphor layer to illuminate.

3. The method according to claim 2, further comprising the step of:

forming apertures around the phosphor layer and control electrode to allow the electrically charged particles to flow through the transfer layer and impinge on the phosphor layer.

4. The method according to claim 3, further comprising the step of:

forming a cathode above the control electrode to emit the electrically charged particles.

5. The method according to claim 4, further comprising the steps of:

stretching the cathode across a face of the fluorescent display device; and connecting ends of the cathode to supports which heat the cathode and cause emission of the electrically charged particles.

6. The method according to claim 4, further comprising the steps of:

disposing a lead wire on the substrate connecting the anode to an external terminal;

forming side plates along a perimeter of the substrate; and forming a transparent cover over the cathodes and in connection with the side plates and completely sealing in the fluorescent display device.

7. The method according to claim 2, wherein the step of press-contacting further comprises the steps of:

heating the base in a range between 180 and 220 degrees celsius; and pressing the base to the fluorescent substrate structure with a force between 50 to 150 kg.

8. The method according to claim 2, wherein the press-contacting step further comprises the step of:

aligning the insulating layer over the control electrode, said insulating layer completely covering the control electrode.

9. The method according to claim 8, wherein:

the control electrode is a grid layer of control electrodes with apertures between each electrode in the grid layer; and the insulating layer is also a grid layer exactly covering each electrode of the control electrode grid layer and no part of the control electrode grid layer contacts the phosphor layer ensuring that the electrically charged particles do not impinge on an unselected portion of the phosphor layer.

10. The method according to claim 2, further comprising the step of:

calcining the fluorescent display device to volatize organic ingredients and to compact the fluorescent display device.

* * * * *